US005833174A

United States Patent [19]

Knight et al.

[11] Patent Number: 5,833,174

[45] Date of Patent: Nov. 10, 1998

[54] BILLOWING ROTARY KITE

[76] Inventors: Carl E. Knight; JoAnn F. Knight, both of 2300-45 Ave., San Francisco, Calif. 94116

[21] Appl. No.: 667,432

[22] Filed: Jun. 21, 1996

[51] Int. Cl.[6] ..... B64C 31/06

[52] U.S. Cl. ..... 244/155 A; 244/153 A; 446/217

[58] Field of Search ..... 244/153 A, 153 R, 244/155 A, 155 R, 33, 34 A; 446/217, 34, 36, 61, 62

[56] References Cited

U.S. PATENT DOCUMENTS

| | | | |
|---|---|---|---|
| 2,835,462 | 5/1958 | Martin | 244/153 A |
| 3,954,236 | 5/1976 | Brown | 244/155 R |
| 4,078,745 | 3/1978 | Knight | 244/153 A |
| 4,624,648 | 11/1986 | Waters | 244/153 A |
| 4,685,642 | 8/1987 | Schloss | 244/153 A |
| 4,830,313 | 5/1989 | Cheng | 244/153 R |
| 5,234,182 | 8/1993 | Renecle | 244/153 R |
| 5,529,266 | 6/1996 | Knight et al. | 244/153 R |

FOREIGN PATENT DOCUMENTS

| | | | |
|---|---|---|---|
| 693597 | 9/1964 | Canada | 244/153 R |

*Primary Examiner*—William Grant
*Attorney, Agent, or Firm*—Robert Charles Hill

[57] ABSTRACT

An improved billowing rotary kite is provided. The rotary kite includes a hollow, collapsible wind receiving surface. An air inlet end of the wind receiving surface is retained open by a collapsible and adjustable frame affixed to the surface on a leading edge of the inlet end. Air flow through the kite is controlled by a flexible trailing edge at an air outlet end of the surface. The flexible trailing edge comprises a plurality of longitudinal vanes that extend about the air outlet end of the surface. The fully collapsible surface, and collapsible and adjustable frame, provide a rotary kite that is fully collapsible for packaging or stowage purposes. The depth of the frame is adjustable for obtaining the highest possible rotative flight characteristics and rotative diving capabilities of the kite. In flight, air currents pass through the air inlet end of the kite, through the surface along a longitudinal axis thereof, and out the outlet end. As air currents pass through the surface, the currents strike the vanes, which increases the air pressure within the surface, causing the kite to billow. Therefore, air billows the surface to retain the kite's shape, thus obviating the need for a longitudinal frame. The configuration of the vanes also causes the kite to rotate about its longitudinal axis while in flight.

15 Claims, 4 Drawing Sheets

FIG. 4
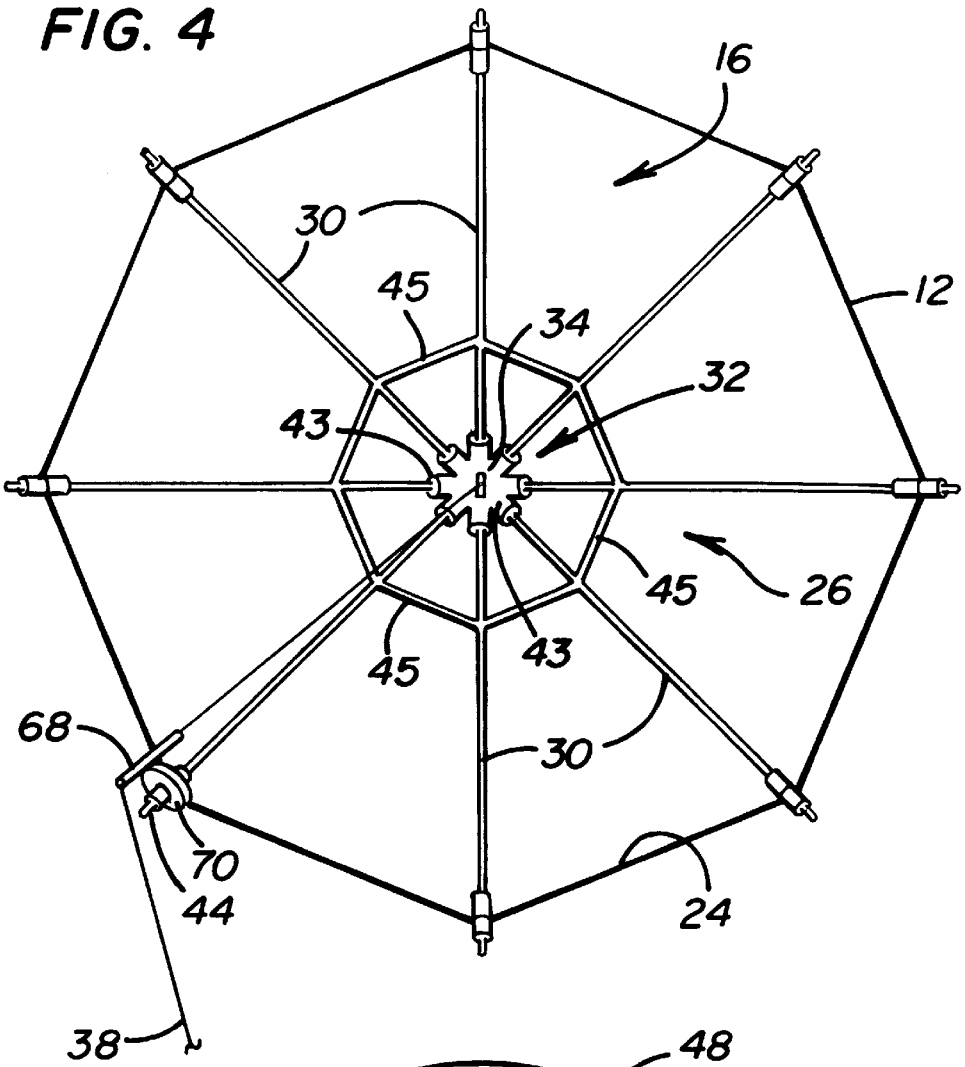
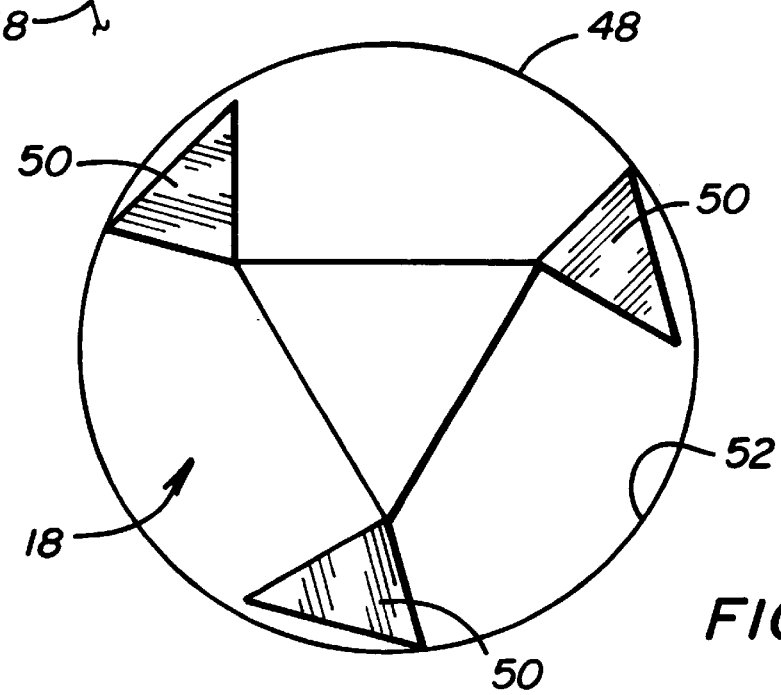
FIG. 6

FIG. 5
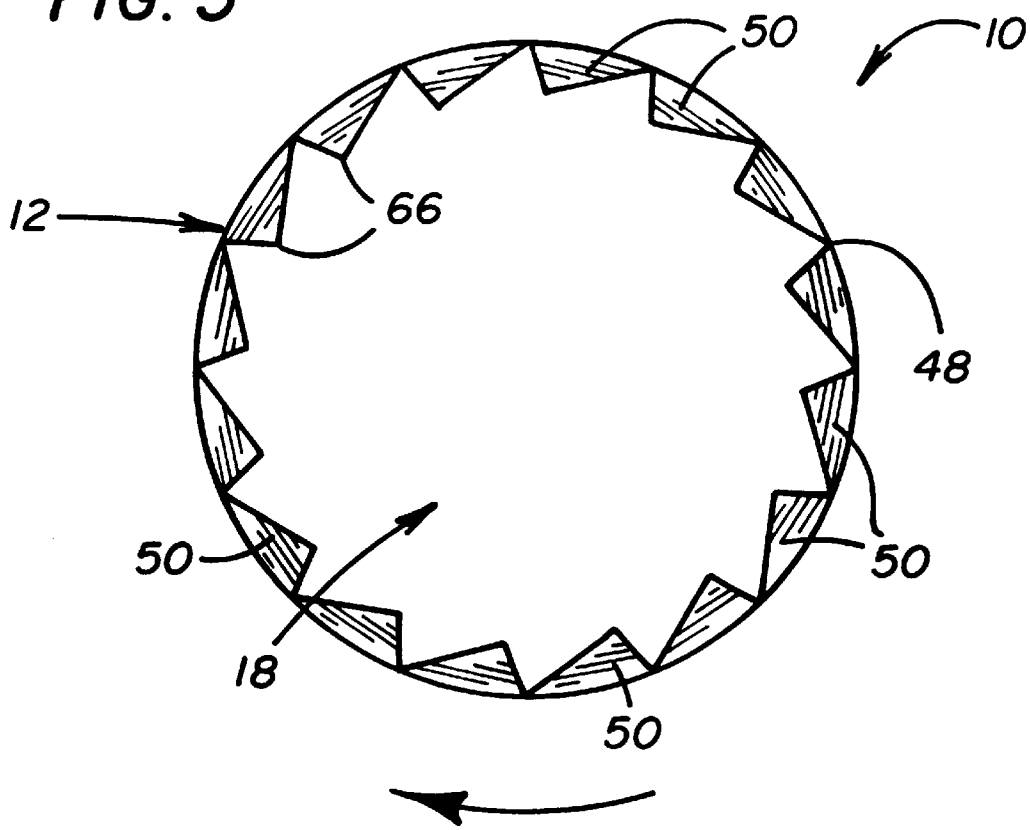
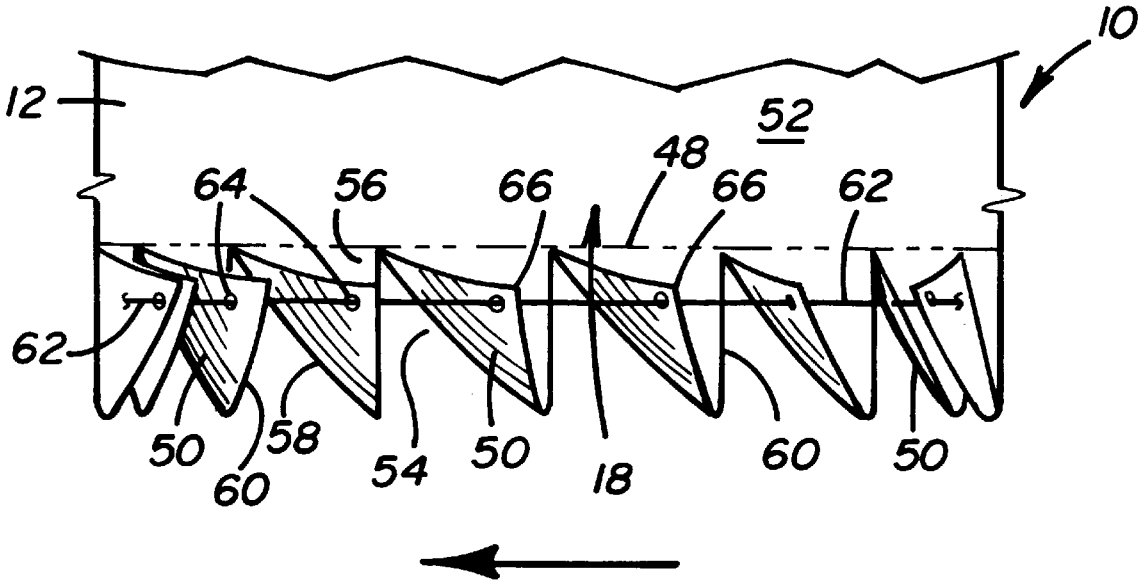
FIG. 7

BILLOWING ROTARY KITE

BACKGROUND OF THE INVENTION

1. Field of the Invention

The present invention relates generally to kites, and more particularly, to an improved rotary kite that billows and is capable of performing aerial maneuvers such as diving.

2. Description of Related Art

Rotary kites are kites that rotate perpendicular to the direction of wind flow when the kite is in flight. An analysis of the history of these kites reveals that designs for a rotary kite that is capable of diving have not been fully explored. Further analysis indicates that designs for rotary kites that billow, thus obviating the need for longitudinal frame means in the kite, also have not yet been completely explored. It therefore appears that it would be advantageous to provide rotary kites that have fully collapsible vanes and wind receiving surface, and a fully collapsible and adjustable frame. However, rotary kites are typically designed with a rigid longitudinal frame and vanes, since it is easier to make an enclosed surface kite both rotate and fly with a longitudinal frame than it is to make one fly without a longitudinal frame. By using a longitudinal frame there is a greater choice in design options. Without a longitudinal frame, the choices become somewhat more restrictive.

However, when properly designed, a billowing rotary kite can have several advantages over a rotary kite with a longitudinal frame. A billowing rotary kite is lighter, has better low wind range stability, and can be designed for controlled rotary diving. It can also be designed to be fully collapsible. A fully collapsible rotary kite is easy to package for sale which makes the kite marketable. The kite can come out of the packaging ready to fly without any required assembly. Also, billowing rotary kites can be dimensioned larger than rotary kites with longitudinal frames.

U.S. Pat. No. 2,835,462, issued to Martin, discloses a rotary kite that illustrates the options available in designing a rotary kite with the use of a longitudinal frame. The longitudinal frame includes a central shaft on which a wind-receiving cylindrical member is rotatably mounted. Light metal or plastic strips are provided to form hoops for supporting the body of the kite. However, a billowing rotary kite does not have the option of employing the longitudinal frame in order to gain lift.

U.S. Pat. No. 4,078,745, issued to Knight et al., and wherein the present inventors are the joint inventors, discloses a rotary kite suitable for rotation in a direction perpendicular to the direction of wind flow. The disclosed kite is provided with a symmetrical wind receiving surface supported by a frame and open ends thereof permitting the passage of air currents therethrough. The kite is provided with at least one vane attached to one end of the frame that extends beyond the frame into the wind flow, to cause rotation. However, the kite is configured with a lifting lip on the longitudinal frame for increasing the lift of the kite. Again, this method of increasing the lift of the kite is not available for a billowing rotary kite, since the billowing kite is not provided with a longitudinal frame.

A wind actuated rotatable tubular device is disclosed in U.S. Pat. No. 3,954,236, issued to Brown. There are several essential differences between the device disclosed therein and a billowing rotary kite. The tubular device is typically configured with frame mounted vanes, while a billowing kite does not include a frame. Also, the tubular device is provided with a rigid air outlet, while the billowing rotating kite requires a flexible air outlet. Further, the device is not restricted to an approximate length to width ratio, while a billowing kite is restricted to such a ratio.

U.S. Pat. No. 4,624,648, issued to Waters, is directed to an aerial toy. The disclosed toy comprises a tubular sleeve of a flexible material and a circular cross section. In one form of the invention, the tubular sleeve tapers from one end toward the other, with air entering the larger head end and moving toward the tail end. The head end is adapted for a bridle connection for supporting the sleeve for wind passage therethrough. The sleeve comprises plural strips extending at least generally longitudinally of the sleeve, with each strip being of substantially right triangular form, at least at the head portion thereof. The strips are arranged with the end margins of the strips secured to a ring to provide airchutes, causing the tubular sleeve to rotate.

A further rotary kite is disclosed in U.S. Pat. No. 5,529,266, which issued on Jun. 25, 1996, wherein Applicants are the inventors. The disclosed rotary kite can be designed as either a billowing rotary kite or a longitudinally structured rotary kite. However, the disclosed kite is not sufficiently designed to provide a rotating kite capable of aerial maneuvers such as diving. Further, the kite disclosed therein is not provided with an adjustable or collapsible frame for packaging or stowage purposes, for example.

There, therefore exists a need for a rotary kite that is fully collapsible and which is capable of aerial maneuvers such as diving.

AOBJECTS OF THE INVENTION

It is therefore an object of the present invention to provide an improved rotary kite;

It is another object of the present invention to provide an improved rotary kite which does not require a longitudinal frame;

It is a further object of the present invention to provide an improved rotary kite that is capable of performing aerial maneuvers such as diving;

It is yet another object of the present invention to provide an improved rotary kite that is fully collapsible;

It is a still further object of the present invention to provide an improved rotary kite that is capable of flying in wind of greatly varying velocities;

It is another object of the present invention to provide an improved rotary kite having an adjustable frame;

It is yet a further object of the present invention to provide improved rotary kite having enhanced lift capabilities; and It is another object of the present invention to provide improved rotary kite that may be dimensioned larger than prior art rotary kites.

SUMMARY OF THE INVENTION

These and other objects and advantages of the present invention are achieved by providing an improved rotary kite constructed according to the principles of the present invention. The invented rotary kite comprises a collapsible, hollow, cylindrical wind receiving surface having a longitudinal axis with an air inlet end and an air outlet end having collapsible vanes extending thereabout. The air inlet end is retained in an open position by a collapsible and adjustable frame affixed to the wind receiving surface on a leading edge of the inlet end.

Air flow through the kite is controlled primarily by a flexible trailing edge on the wind receiving surface at the air outlet end. The flexible trailing edge comprises a plurality of longitudinal vanes on the wind receiving surface that extend about the outlet end. The fully collapsible surface and vanes, and collapsible and adjustable frame, provide a rotary kite that is fully collapsible for packaging or stowage purposes. Thus, the kite can be removed from packaging and flown without any assembly. The depth of the frame is adjustable for obtaining the highest possible rotative flight characteristics and rotative diving capabilities of the kite under various wind conditions.

In flight, air currents pass through the air inlet end of the kite, through the hollow wind receiving surface along the longitudinal axis, and out the outlet end. As air currents pass through the hollow surface, the currents strike the longitudinal vanes on the trailing edge. The action of the air currents striking the vanes increases the air pressure within the hollow wind receiving surface, causing the kite to billow. Therefore, while in flight, air billows the wind receiving surface to retain the kite's shape, thus obviating the need for a longitudinal frame. Further, the configuration of the vanes causes the kite to rotate about its longitudinal axis as air currents pass through the surface. The invented kite rotates about its longitudinal axis, which is substantially perpendicular to the direction of wind currents along the kite. The rotation of the kite's wind receiving surface aids with maintaining the kite's shape while in flight.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

FIG. 4 is an end view showing the air inlet end of preferred embodiment of the present invention;

FIG. 5 is an end view showing a preferred embodiment of an outlet end of the rotary kite of the present invention;

FIGS. 6 is an end view showing an alternative embodiment of the outlet end of the present invention; and FIG. 7 is a fragmentary side elevational view showing the outlet end of the invented rotary kite.

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein.

Figure 1:
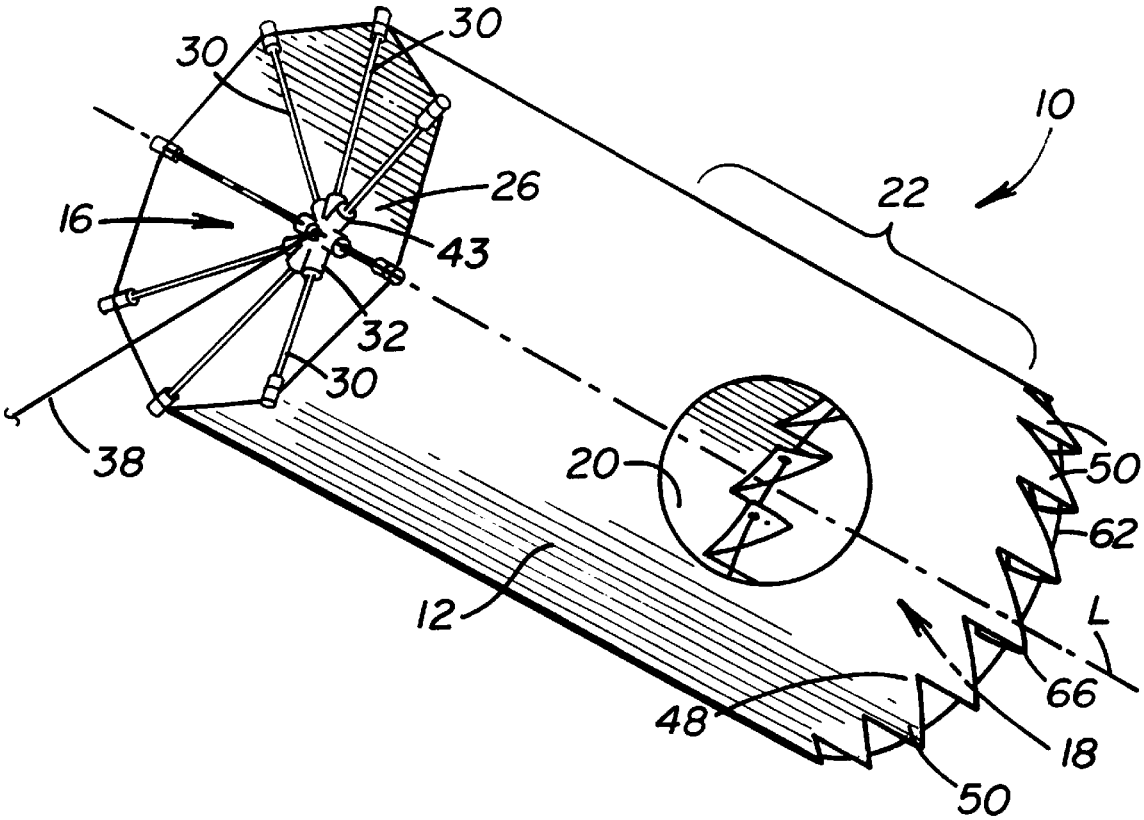
FIG. 1 is a side elevational view showing a rotary kite of the preferred embodiment of the present invention.

Referring now to FIG. 1 of the drawings, there is shown a preferred embodiment of a rotary kite 10 constructed according to the principles of the present invention. The invented rotary kite 10 is fully collapsible, adjustable, billows, and is capable of aerial maneuvers such as diving. The preferred embodiment of the kite 10 includes a hollow, collapsible, cylindrical wind receiving surface 12 that is symmetrical about a longitudinal axis L thereof. The surface 12 has an air inlet end 16 and an air outlet end 18 that allow air currents to pass therethrough. The wind receiving surface 12 may be fabricated from any suitable lightweight, supple material known in the art. Such materials may include nylon fabric, plastic, cloth, or paper, for example. However, the chosen material comprising the surface 12 must be supple in order to allow the wind receiving surface 12 to fully collapse.

lift of the kite 10 can be increased, particularly if the kite 10 is designed to be less than approximately two feet in length, by forming vents 20 through the surface 12. One or more vents 20 having any appropriate aerodynamic size or shape can be formed through the wind receiving surface 12, in a venting region 22 that extends from the outlet end 18 toward the center of the surface 12. The total surface area of the vents 20 can equal up to approximately 50% of the surface area of the venting region 22.

Figure 2:
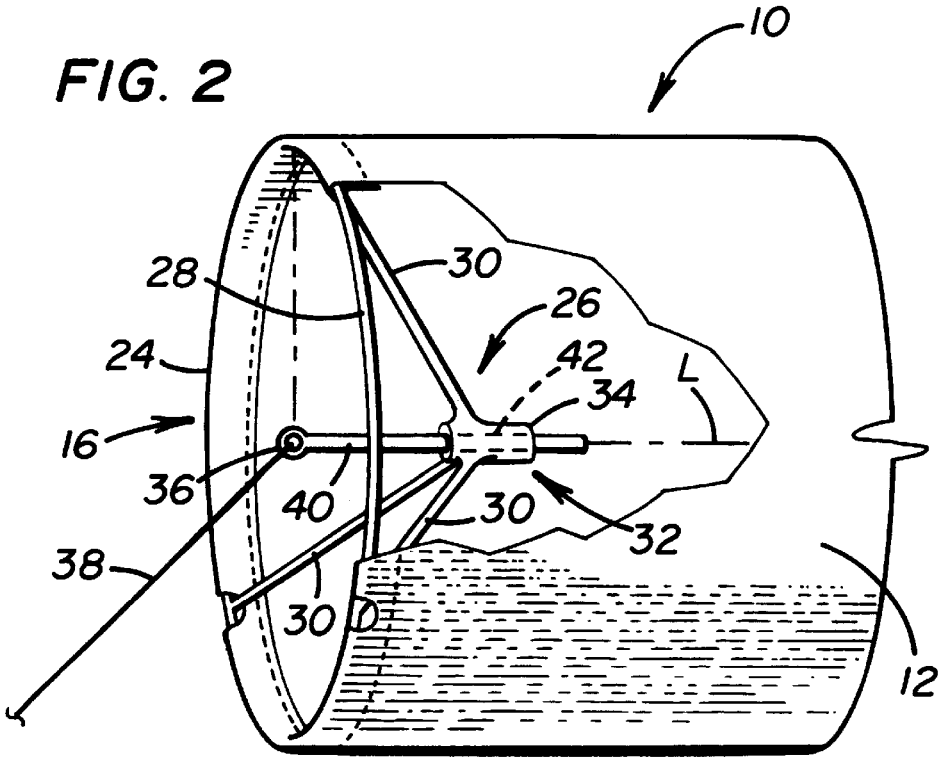
FIG. 2 is a fragmentary side elevational view showing an air inlet end of the invented kite having an adjustable and collapsible frame.
Figure 3:
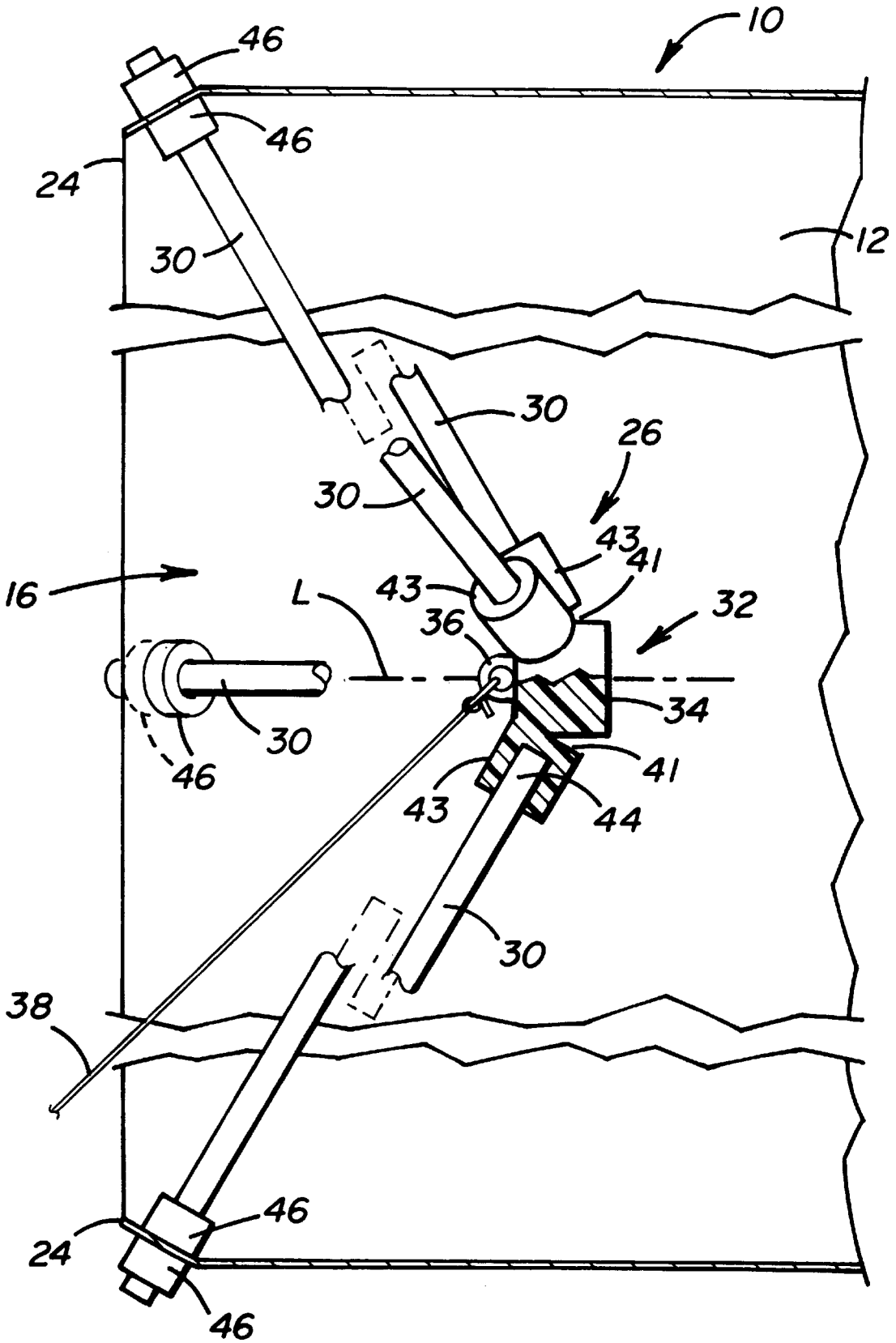
FIG. 3 is a fragmentary side elevational view showing the preferred embodiment of the adjustable and collapsible frame.

Referring now to FIGS. 2–4 of the drawings, there is shown the air inlet end 16 of the kite 10 of the present invention. The air inlet end 16 is configured with a leading edge 24 extending about the periphery thereof. A collapsible frame, shown generally at 26, is provided to maintain the annular shape of the inlet end 16, for allowing air to flow through the cylindrical wind receiving surface 12 when the kite 10 is in flight. The frame 26 includes an annular member 28 (shown in FIG. 2) that extends parallel to the leading edge 24 and is affixed thereto. A plurality of rods 30 are secured to the leading edge 24 with the annular member 28 and extend radially inwardly to a central yoke, shown generally at 32. The yoke 32 includes a flexible hub 34 that is aligned with the longitudinal axis L, and is provided with a connecting member 36, such as an eyelet, for connecting a cord or line 38 to the kite 10, to enable a user to hold the kite 10 during flight.

As shown in FIG. 2, the yoke 34 may be configured with an axial rod 40 that is retained in an aperture 42 formed through the hub 34 and aligned with the longitudinal axis L. When provided, the axial rod 40 extends toward the inlet end 16 along the longitudinal axis L. The axial rod 40 enhances control of the kite 10 during rotative flight. The aperture 42 is configured to frictionally engage the rod 40, to prevent inadvertent movement between the rod 40 and hub 34. The eyelet 36 is affixed to an end of the axial rod 40 for connecting the line 38 to the frame 26. The axial rod 40 is longitudinally adjustable so that the eyelet 36 may be aligned with the leading edge 24 of the air inlet end 16 or may form an angle of approximately 60° therewith. Thus, the line 38 can be connected to the frame 26 an angles ranging from approximately 60° to 90° with the leading edge 24, for the best rotative flight and diving of the kite 10 in different prevailing wind conditions.

The hub 34 has a plurality of resilient sockets 43 that extend radially outwardly therefrom for retaining ends 44 of the rods 30 therein. The yoke 32 is preferably fabricated from suitable resilient materials, such as suitable plastics, including plasticized polyvinyl chloride, or known rubber compounds, for example. A slit 41 is formed between each of the radially extending sockets 43 and the hub 34 for flexibly coupling the sockets 43 to the hub 34. The slits 41 enable the sockets 43 to flex inwardly toward the inlet end 16 for collapsing the frame 26. Thus, the frame 26 enables the kite 10 to fully collapse. The yoke 32 is designed to lock in place when the rods 30 are at an angle of approximately 90° to the longitudinal axis L. The yoke 32 can be recessed into the wind receiving surface 12 of the kite 10 at varying depths, by adjusting the angle that the sockets 43 form with the hub 34.

The slits 41 between the sockets 43 and hub 34 enable the rods 30 to form an angle ranging from approximately 60° to approximately 90° with the axis L of the kite 10. The ends 44 of the rods 30 are adjusted into the sockets 43, and through the leading edge 24 and annular member 28 (when provided), for evenly adjusting the frame 26 into kite's surface 12. The depth of the frame 26 is adjustable for obtaining the best possible rotative flight characteristics and rotative diving capabilities of the kite 10 for prevailing wind conditions.

Referring still to FIGS. 2–4 of the drawings, the rods 30, along with the axial rod 40, preferably comprise a suitable strong, light, rigid material known in the art such as wood, plastic, or other suitable materials. When the frame 26 is configured with less than four rods 30, it is preferable to configure the inlet end 16 with the annular member 28. The rods 30 can be secured to the annular member 28 by any suitable means, such as by being an integral part of the annular member 28 or by frictionally engaging the member 28, for example. The annular member 28 may be fabricated from any appropriate light, rigid material, such as plastic or wood. The member 28 is affixed to the surface's leading edge 24 by suitable means such as by gluing, taping, sewing, or heat sealing. If desired, the kite 10 can also operate with only one rod member 30, especially when frame 26 and the hub 34 are rigid.

When the frame 26 is configured with four or more rods 30, the annular member 28 is not essential for rotative flight and diving. However, for additional strength, one or more support members 45 can be attached to the rods 30 between the yoke 32 and leading edge 22 using any known means. The support members 45 may be configured either angular or annular. When the frame 26 is configured with four or more rods 30, the rods 20 can be secured to the wind receiving surface 12 adjacent to the leading edge 24 by any suitable means. For example, ends 44 of the rods 30 may be disposed through a hole (not shown) formed in the wind receiving surface 12 adjacent to the leading edge 24 and held in place by appropriate means, such as plastic tubing 46 adjustable on rods 30.

Referring now to FIG. 1 and FIGS. 5–7 of the drawings, there is shown the air outlet end 18 of the rotary kite 10 of the present invention. The outlet end 18 includes a flexible trailing edge 48 formed about the periphery thereof. The flexible trailing edge 48 has a plurality of longitudinal vanes 50 attached thereto. The vanes 50 are provided to billow the wind receiving surface 12 and are configured triangular to rotate the kite 10 during flight. Preferably, a multiplicity of vanes 50 are provided, such that a continuous series of vanes 50 extend about the trailing edge 48. However, as few as three of the vanes 50 may be coupled to the trailing edge 48, which is still sufficient to provide billowing of the surface 12 and rotative flight of the kite 10.

The vanes 50 can comprise from approximately 2% to 10% of the surface area of the wind receiving surface 12. The vanes 50 can be any aerodynamically suitable shape, but are preferably triangular and are set at an angle ranging from approximately 30° to approximately 45° to the direction of wind flow along the kite's wind receiving surface 12. Vane vents 54 are formed between each of the vanes 50 on the leeward side thereof, due to the triangular configuration of the vanes 50. The vanes 50 each include a base 56 that is parallel to the trailing edge 48 and is affixed thereto, a hypotenuse 58 that forms an angle of approximately 45° with the trailing edge 48, and a height 60 that forms an angle of approximately 90° with the trailing edge 48.

The vanes 50 may be fabricated from any suitable lightweight, material known in the art, such as nylon fabric, plastic, cloth, or paper, for example. The vanes 50 can be attached to either an inner surface 52 of the wind receiving surface 12 or the wind receiving surface 12 along the trailing edge 48. The vanes are attached to the surface 12 by any suitable means such as sewing, heat sealing, gluing, or other well known methods. However, the vanes 50 are preferably integrally formed with the wind receiving surface 12, along the trailing edge 48. Thus, in this embodiment, the vanes 50 comprise the same portion of material used to fabricate the surface 12.

When the vanes 50 are fabricated from the same supple material comprising the wind receiving surface 12, or other similar material, or if the vanes 50 are greater than two square inches, a continuous vane strand 62 should be provided to interconnect the vanes 50, for retaining the vanes 50 at the preferred angle to the direction of wind flow along the kite 10. The strand 62 retains the vanes 50 at the preferred angle for billowing and rotation of the kite 10 during flight. The vane strand 62 is attached to the vanes 50 by any suitable means, such as by passing the strand 62 through an opening 64 formed in each of the vanes 50. The opening 64 is formed through each of the vanes 50 approximately ¼ inch below an apex 66 of each vane 50, so that the vanes 50 adjust themselves to the correct angle to wind flow when billowing the kite's wind receiving surface 12.

The vane strand 62 encircles the kite's longitudinal axis L, and has a circumference ranging from approximately 50% to approximately 85% of the circumference of the wind receiving surface 12. The vane strand 62 may comprise any suitable material, such as light nylon thread, string, or other known cordage. However, if the trailing edge 48 is configured with vanes 50 that are somewhat rigid or are less than two square inches, the vane strand 62 may not be required to retain the vanes 50 at the preferred angle to wind flow. Air flow through the kite 10 is controlled by the leading edge 24, the length to width ratio of the kite's wind receiving surface 12, the flexible trailing edge 48, the vanes 50, the vents 20, and the vane vents 54.

The kite 10 is controlled in rotative diving by manipulating the line 38 in any effective way, such as by allowing a short rod member 68 (shown in FIG. 4) affixed to the line 38 to come in contact with a projection 70 on the end 44 of one of the rods 30. This will unbalance the frame 26 and cause the kite 10 to go into a rotative dive. When the line 38 becomes taut, the kite 10 will resume rotative flight.

Thus, there has been described an improved rotary kite having a wind receiving surface without longitudinal frame means. In flight, the action of the air currents striking the vanes causes the kite to billow, obviating the need for a longitudinal frame. Further, the configuration of the vanes causes the kite to rotate about its longitudinal axis as air currents pass through the wind receiving surface, thus the kite is capable of performing aerial maneuvers such as diving. The depth of the frame is adjustable for obtaining the highest possible rotative flight characteristics and rotative diving capabilities of the kite for various prevailing wind conditions. The collapsible wind receiving surface, collapsible vanes, and collapsible and adjustable frame, provide a rotary kite that is particularly well suited for packaging or stowage purposes. The kite can be removed from packaging and flown without any assembly.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A billowing rotary kite suitable for flight and rotation in a direction perpendicular to the wind flow comprising:

a hollow, symmetrical, collapsible wind receiving surface, the surface having an air inlet end and an air outlet end, and a longitudinal axis;

an adjustable and collapsible frame means secured to the air inlet end of the wind receiving surface, the frame means including a central flexible hub with a plurality of connecting members coupling the hub to the air inlet end of the surface; and a plurality of collapsible vanes formed about the periphery of the outlet end of the wind receiving surface along a trailing edge thereof and spatially positioned thereabout, the vanes being configured to induce rotation of the wind receiving surface perpendicular to the longitudinal axis thereof as air currents pass through the surface while the kite is in flight, as air currents pass through the surface, the vanes increasing the air pressure within the hollow wind receiving surface for causing the kite to billow for retaining the shape of the wind receiving surface and for supporting the air outlet end in an open condition.

2. The kite of claim 1 further comprising:

a line coupled to the frame means for enabling a user to hold the kite during flight, the line having a rigid member affixed thereto adjacent a leading edge of the air inlet end; and a projection affixed to an end of a desired one of the connecting members, whereby the rigid member contacts the projection while the kite is in flight, causing the rotation of the wind receiving surface to become unbalanced to induce the kite into a rotative dive, the line becoming taut as the kite dives causing the kite to resume rotative flight.

3. The kite of claim 2 wherein the frame means further includes:

the hub comprising a central hub portion having a plurality of resilient receiving means extending outwardly therefrom, each of the receiving means receiving an end of each of the connecting members, the receiving means flexibly coupled to the hub portion, such that the receiving means flex inwardly toward the inlet end of the wind receiving surface;

a coupling member affixed to the central hub portion for connecting the line to the frame means; and the plurality of connecting members being secured to the inlet end adjacent to the leading edge thereof and retained in the receiving means, such that the connecting members are adjustable inward toward the longitudinal axis of the surface and forwardly toward the inlet end for collapsing the frame means and thus the inlet end for providing a collapsible rotary kite.

4. The kite of claim 3 wherein the frame means further includes an aperture disposed through the central hub portion aligned with the longitudinal axis of the wind receiving surface, and an axial rod adjustably retained in the aperture and extending toward the inlet end along the longitudinal axis, the axial rod having the coupling member affixed at a first end thereof to enhance control of the kite during rotative flight.

5. The kite of claim 4 wherein the axial rod is longitudinally adjustable, such that the first end thereof form an angle ranging from approximately sixty degrees to approximately ninety degrees with the leading edge of the air inlet end.

6. The kite of claim 1 wherein the vanes are configured such that they form an angle ranging from approximately thirty degrees to approximately forty five degrees to the direction of wind flow along the wind receiving surface.

7. A collapsible billowing rotary kite suitable for flight and rotation in a direction perpendicular to the wind flow comprising:

a hollow, symmetrical, wind receiving surface comprising a supple material that enables the surface to be substantially collapsible, the surface having an air inlet end with a leading edge formed about the periphery thereof and an air outlet end having a flexible trailing edge extending thereabout, and a longitudinal axis;

an adjustable and collapsible frame means secured to the air inlet end of the wind receiving surface, the frame means comprising.

a hub aligned with the longitudinal axis of the wind receiving surface, the hub having a plurality of receiving members extending radially outwardly therefrom flexibly coupled to a central portion thereof, the hub having an aperture disposed therethrough aligned with the longitudinal axis, a plurality of rod members and collapsible retaining means for retaining the inlet end of the wind receiving surface in an open position for allowing air currents to flow therethrough when the kite is in flight, each of the rods having an end detachably retained in the receiving members of the hub and having another end adjustably coupled to the retaining means for coupling the frame means to the inlet end of the surface, an axial rod adjustably retained in the aperture and extending toward the inlet end along the longitudinal axis, the axial rod having a coupling member affixed at a first end thereof for connecting a line to the frame means for controlling the kite during flight, the first end of the axial rod being substantially aligned with the leading edge of the wind receiving surface to enhance control of the kite during rotative flight; and a plurality of vanes comprising a supple material that enables the vanes to be substantially collapsible, the vanes being coupled to the trailing edge of the outlet end and extending continuously thereabout, the vanes being configured such that they form an angle to the direction of wind flow along the wind receiving surface to induce rotation of the kite perpendicular to the longitudinal axis thereof during flight, the vanes including means for retaining the vanes inwardly such that they extend from the trailing edge toward the longitudinal axis, as air currents pass through the surface, the air currents striking the vanes for increasing the air pressure within the hollow wind receiving surface for causing the kite to billow for retaining the shape thereof.

8. The kite of claim 7 wherein the line has a rigid member affixed thereto adjacent the leading edge of the air inlet end and a projection affixed to an end of a desired one of the rod members, whereby the rigid member contacts the projection while the kite is in flight, causing the rotation of the wind receiving surface to become unbalanced to induce the kite into a rotative dive, the line becoming taut as the kite dives causing the kite to resume rotative flight.

9. The kite of claim 7 wherein the axial rod is longitudinally adjustable such that the first end thereof may form an angle ranging from approximately sixty degrees to approximately ninety degrees with the leading edge of the air inlet end for enhancing control of the kite during rotative flight, the axial rod being frictionally engaged by the aperture disposed through the central portion of the hub to prevent inadvertent longitudinal movement thereof.

10. The kite of claim 7 further including a plurality of support members extending between each of the rod members and affixed thereto, the support members being positioned between the hub and leading edge for increasing the rigidity of the frame means.

11. The kite of claim 7 wherein the angle of the vanes to the direction of wind flow along the wind receiving surface is an angle ranging from approximately thirty degrees to approximately forty five degrees to the direction of wind flow.

12. The kite of claim 7 wherein the vanes are substantially triangular, each of the vanes including a base affixed to the trailing edge, a hypotenuse forming an angle of approximately forty five degrees with the trailing edge, and a height forming an angle of approximately ninety degrees with the trailing edge.

13. The kite of claim 7 wherein the means for retaining the vanes inwardly for increasing the air pressure within the wind receiving surface comprises a continuous flexible strand interconnecting the vanes, the strand having a diameter less than the diameter of the wind receiving surface.

14. The kite of claim 13 wherein the strand has a diameter ranging from approximately one half to approximately three quarters of the diameter of the wind receiving surface.

15. A billowing rotary kite suitable for flight and rotation in a direction perpendicular to the wind flow comprising:

a hollow, symmetrical, collapsible wind receiving surface, the surface having an air inlet end and an air outlet end, and a longitudinal axis;

an adjustable frame means secured to the air inlet end of the wind receiving surface, the frame means including a central hub with at least one connecting member coupling the hub to the air inlet end of the surface; and a plurality of collapsible vanes formed about the periphery of the outlet end of the wind receiving surface along a trailing edge thereof and spatially positioned thereabout, the vanes being configured to induce rotation of the wind receiving surface perpendicular to the longitudinal axis as air currents pass through the surface while the kite is in flight, as air currents pass through the surface, the vanes increasing the air pressure within the hollow wind receiving surface for causing the kite to billow for retaining the shape of the wind receiving surface and for supporting the air outlet end in an open condition.

* * * * *